US005658174A

United States Patent [19]

Benes et al.

[11] Patent Number: 5,658,174

[45] Date of Patent: Aug. 19, 1997

[54] FEMALE ELECTRICAL TERMINAL

[75] Inventors: Kevin C. Benes, Willowbrook; John O. Higgins, Jr., Berwyn; Stephen A. Colleran, Lisle, all of Ill.

[73] Assignee: Molex Incorporated, Lisle, Ill.

[21] Appl. No.: 565,750

[22] Filed: Dec. 1, 1995

[51] Int. Cl.[6] ..... H01R 13/187

[52] U.S. Cl. ..... 439/843; 439/842; 439/846

[58] Field of Search ..... 439/843, 842, 439/844, 845, 846, 852

[56] References Cited

U.S. PATENT DOCUMENTS

| | | | |
|---|---|---|---|
| 3,842,391 | 10/1974 | Dechelette | 439/842 |
| 5,186,664 | 2/1993 | Abe | 439/845 |
| 5,226,842 | 7/1993 | Endo et al. | 439/843 |
| 5,271,741 | 12/1993 | Saito et al. | 439/843 |
| 5,340,338 | 8/1994 | Sai et al. | 439/845 |
| 5,427,552 | 6/1995 | Zielinski et al. | 439/845 |
| 5,427,553 | 6/1995 | Tsuji | 439/842 |
| 5,433,629 | 7/1995 | Yagi et al. | 439/843 |
| 5,441,428 | 8/1995 | Hamai et al. | 439/843 |

FOREIGN PATENT DOCUMENTS

| | | | |
|---|---|---|---|
| 07050178 | 2/1995 | Japan | H01R 13/15 |

*Primary Examiner*—David L. Pirlot
*Assistant Examiner*—Tho D. Ta
*Attorney, Agent, or Firm*—A. A. Tirva

[57] ABSTRACT

A female terminal includes a bottom wall, and a pair of opposing side walls extending upwardly from opposite sides of the bottom wall. A hole is formed in each side wall near the top thereof. Top half walls extend inwardly from the tops of the side walls and define a seam therebetween. A spring contact element is located inside the seam and include lug portions engageable in the holes near the tops of the side walls to bias a male terminal into engagement with the bottom wall.

10 Claims, 3 Drawing Sheets

FEMALE ELECTRICAL TERMINAL

FIELD OF THE INVENTION

This invention generally relates to the art of electrical connectors and, particularly, to a female terminal for use in an electrical connection.

BACKGROUND OF THE INVENTION

Very generally, a typical electrical connector combination includes a plug connector and a receptacle connector, both of which mount or house interengageable electrical terminals. The plug connector is inserted into or mated with the receptacle connector to interengage the terminals. The terminals may take a variety of configurations, including male and female or pin and socket terminals.

A known type of female socket terminal is elongated and has a terminating end and a contact end. The terminating end may be adapted for termination to an electrical wire, for instance. The contact end is box-shaped or generally rectangular in cross-section for receiving a male or pin contact or terminal. The female socket terminal typically is stamped and formed from sheet metal material, and spring sections may be stamped therefrom for resiliently gripping the pin contact or terminal. On the other hand, separate spring contact elements have been used with such female socket terminals.

For example, in U.S. Pat. No. 5,441,428, dated Aug. 15, 1995, a female socket terminal employs a separate spring element to resiliently grip an inserted pin contact or terminal. In particular, the female socket terminal disclosed therein is generally rectangular in cross-section and includes a bottom plate portion having two sides. A pair of opposing side plate portions extend upwardly from both sides of the bottom plate portion. Two lug engagement holes are formed in the two side plate portions immediately adjacent the bottom plate portion. A pair of opposing top plate half portions extend inwardly from upper ends of the side plate portions. A spring element is mounted within the female terminal and includes a spring body and a pair of lug portions engaged within the lug engagement holes formed in the two side plates portions near the bottom plate portion. During assembly, the top plate half portions and the side plate portions are spread apart to allow insertion of the spring element transverse to the longitudinal direction of the terminal until the lug portions of the spring element engage within the lug engagement holes formed in the two side plate portions near the bottom wall.

Problems are encountered with female socket terminals as described above in relation to the U.S. Pat. No. 5,441,428 patent. One problem may occur when the top plate half portions are not planar to each other resulting in a reduced surface contact area between the mating pin and the top wall. A second problem may occur because the spring element that grips the mating pin contact or terminal is mounted against the bottom plate portion of the female terminal and biases the male terminal upwardly against the top plate half portions which are joined at an open seam. This tends to open the seam and spread the opposing side plate portions of the female terminal which, in turn, reduces the contact forces on the mating male terminal. In addition, spreading and closing the female terminal tends to eventually loosen the intended interconnection. Lastly, assembling the spring element into the box-shaped female terminal transverse to the longitudinal direction of the terminal is a costly and cumbersome procedure.

The present invention is directed to solving the above problems and providing a box-type female socket terminal which is more reliable and easier to manufacture than the prior art.

SUMMARY OF THE INVENTION

An object, therefore, of the invention is to provide a new and improved female electrical terminal of the character described.

In the exemplary embodiment of the invention, the female electrical terminal is elongated and includes a contact end and a terminating end. The contact end is generally rectangular in cross-section and is adapted to receive a male or pin contact. The contact end includes a bottom wall, and a pair of opposing side walls extending upwardly from opposite sides of the bottom wall. A lug-engaging hole is formed in each side wall near the top thereof. A pair of opposing top half walls extend inwardly from the tops of the side walls and define a seam therebetween. A spring contact element is located in the contact end, inside the seam and is adapted to bias the male contact into engagement with the bottom wall. The lug portions of the spring contact element engage in the lug-engaging holes.

With the structure of the female electrical terminal described immediately above, the male terminal is biased against the solid bottom wall of the contact end rather than upwardly against the top half walls and the open seam. Therefore, there is no tendency to spread the contact end apart. In addition, the spring contact element may be more easily assembled into the contact end longitudinally of the terminal rather than transversely thereof.

As disclosed herein, the spring contact element includes a cantilevered contact blade which is sufficiently wide to engage substantial portions of the top half walls on opposite sides of the seam. Another feature is the inclusion of a raised boss in the bottom wall, adapted for engaging the male terminal. Preferably, the raised boss is provided by a raised rib extending longitudinally of the terminal. Such a raised rib could not be provided in the prior art because of the open seam against which the male terminal is biased.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
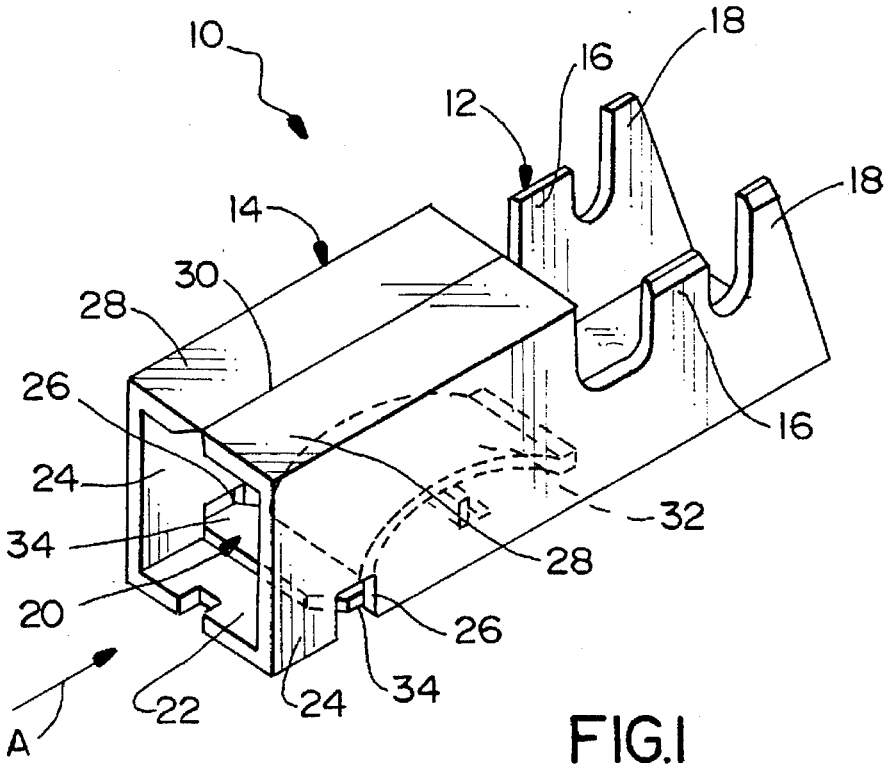
FIG.1 (PRIOR ART)
FIG. 1 is a perspective view of a female electrical terminal according to the prior art.

Referring to the drawings in greater detail, and first to FIG. 1, an elongated female electrical terminal, generally designated 10, is shown according to the prior art. Female terminal 10 includes a terminating end, generally designated 12, and a contact end, generally designated 14. Terminating end 12 includes two pairs of crimp arms 16 and 18 for clamping onto an electrical wire. Contact end 14 is generally box-shaped or rectangular in cross-section and mounts a spring element, generally designated 20, for resiliently gripping a pin contact or male terminal inserted into the contact end in the direction of arrow "A".

Prior art female terminal 10 is shown in the aforementioned U.S. Pat. No. 5,441,428. As described therein, contact end 14 includes a bottom plate portion 22 and two side plate portions 24 extending upward from both sides of the bottom plate portion. Two lug engagement holes 26 are formed in both side plate portions 24 immediately above bottom plate portion 22. A pair of opposing top plate half portions 28 extend inwardly from upper ends of side plate portions 24 and are joined at an open seam 30 due to the fact that the terminal is stamped and formed of sheet metal material.

Spring element 20 of prior art female terminal 10 includes a cantilevered and bowed spring body 32 projecting rearwardly in the terminal, and a pair of lug portions 34 engage within lug engagement holes 26 formed in the two side plate portions 24. When a pin contact or male terminal is inserted into contact end 14 in the direction of arrow "A", spring body 32 of spring element 20 biases the male terminal upwardly against top plate half portions 28 which, in turn, problematically tends to open seam 30, particularly if the male terminal is cylindrical.

Figure 2:
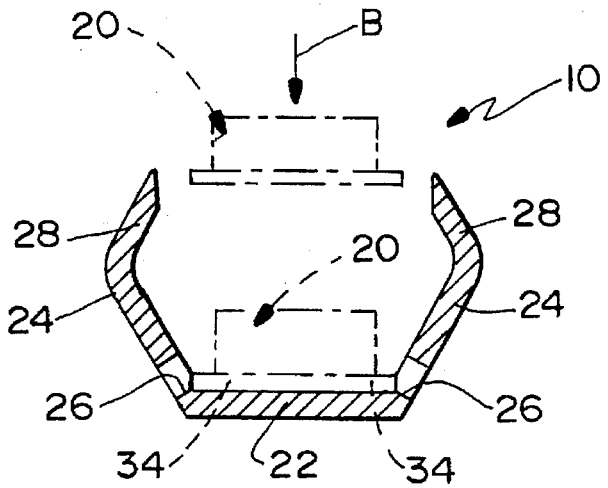
FIG.2 (PRIOR ART)
FIG. 2 is a transverse section through the female terminal of the prior art during a step of assembly thereof.

In addition, FIG. 2 shows the method of assembling prior art female terminal 10. During assembly, side plate portions 24 and opposing top plate half portions 28 are spread apart, as shown, a sufficient distance for spring element 20 to be inserted in the direction of arrow "B". In other words, the spring element is inserted into contact end 14 perpendicular or transversely of the longitudinal direction of the terminal. The spring contact element is inserted downwardly until lugs 34 engage within lug engagement holes 26 at the bottom of side plate portions 24 near bottom wall 22, as shown in phantom in FIG. 2. The side plate portions and the top plate half portions then are closed about the spring element to the closed configuration shown in FIG. 1 and described above.

It should be understood that the use of such terms as "top" and "bottom" herein and in the claims hereof is not intended to be limiting, but to provide a clear and concise understanding of the invention, because the terminal herein is omnidirectional in structure and use.

Figure 3:
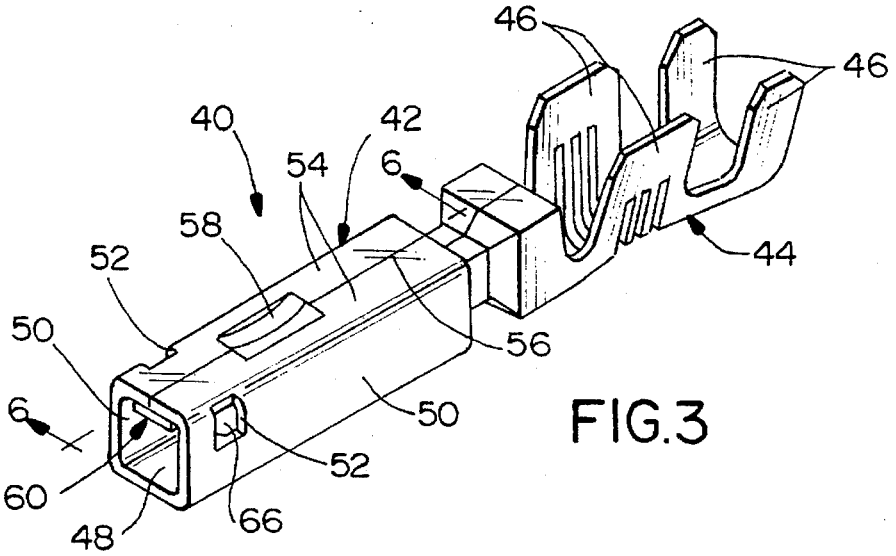
FIG. 3 is a perspective view of a female electrical terminal incorporating the concepts of the invention.

Referring to FIG. 3, an elongated female electrical terminal, generally designated 40, is shown embodying the concepts of the present invention. The female terminal includes a contact end, generally designated 42, and a terminating end, generally designated 44. The contact end is generally box-shaped or rectangular in cross-section. The terminating end includes two pairs of crimp arms 46 for clamping onto an electrical wire.

Contact end 42 of female terminal 40 includes a bottom wall 48 and a pair of opposing side walls 50 extending upwardly from opposite sides of the bottom wall. A lug-engaging opening or hole 52 is formed in each side wall 50 near the top thereof. A pair of opposing top half walls 54 extend inwardly form the tops of side walls 50 and define a seam 56 therebetween. An inwardly concave detent 58 is formed in top half walls 54 spanning seam 56. The detent 58 provides an anti-overstress means for the contact blade of the spring contact element described hereinafter. The entire elongated female electrical terminal 40, including contact end 42, is stamped and formed from conductive sheet metal material.

Figure 4:
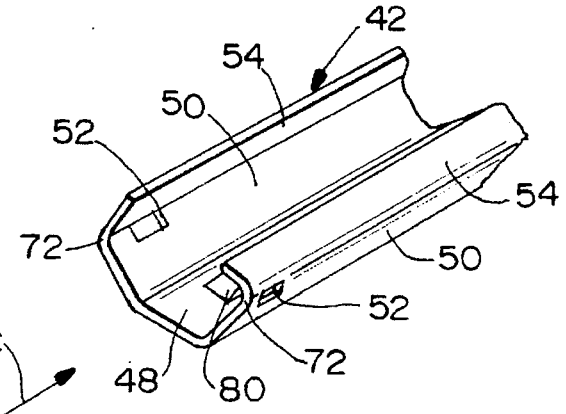
FIG. 4 is an exploded perspective view illustrating one step in the method of fabricating the female terminal of FIG. 3.
Figure 4:
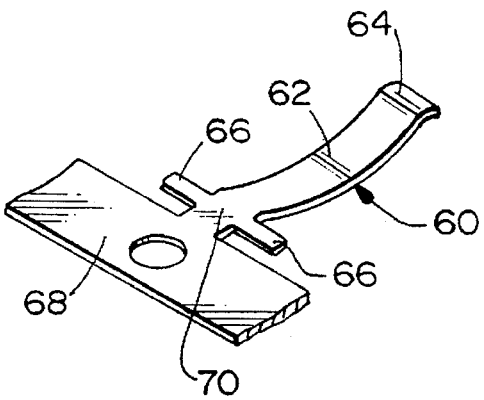

Referring to FIG. 4 in conjunction with FIG. 3, a spring contact element, generally designated 60, includes a cantilevered, inwardly bowed contact blade 62 terminating in a rounded distal end 64. A pair of lug portions 66 project transversely outwardly from the end of contact blade 62 opposite distal end 64. One of the lug portions 66 is shown projecting into one of the lug-engaging holes 52 in one of the side walls 50 in FIG. 3.

Spring contact element 60 is shown in FIG. 4 in a stage of manufacture wherein the spring contact element still is joined to a carrier strip 68 by a web portion 70. It readily can be seen that the spring contact element is stamped and formed from conductive sheet metal material, and a plurality of the spring contact elements are stamped and formed lengthwise along carrier strip 68 joined by web portions 70.

During manufacture or fabrication of female electrical terminal 40, and still referring to FIG. 4, side walls 50 and opposing top half walls 54 are spread apart, as shown, a sufficient distance for lug portions 66 of spring contact element 60 to be inserted in the direction of arrow "C". The side walls and top half walls need to be spread only a distance sufficient for the lug portions to pass between the junctures, as at 72, between the side walls and the top half walls.

Figure 5:
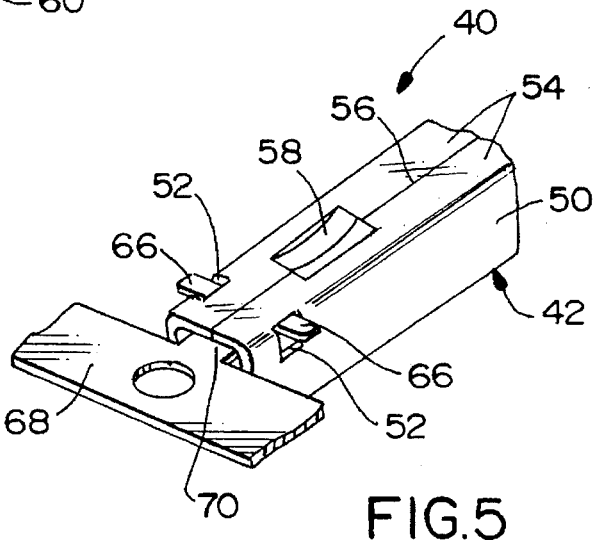
FIG. 5 is a subsequent step in manufacturing the female terminal.

Once lug portions 66 are aligned with lug-engaging holes 52 in side walls 50, the side walls and top half walls 54 are closed about the spring contact element as shown in FIG. 5. It can be seen that the lug portions are engaged within the holes. The spring contact element then is broken away from carrier strip 68 by severing the respective web portion 70 whereby the spring contact element now is captured within contact end 42 of the terminal as shown in FIG. 3.

Figure 6:
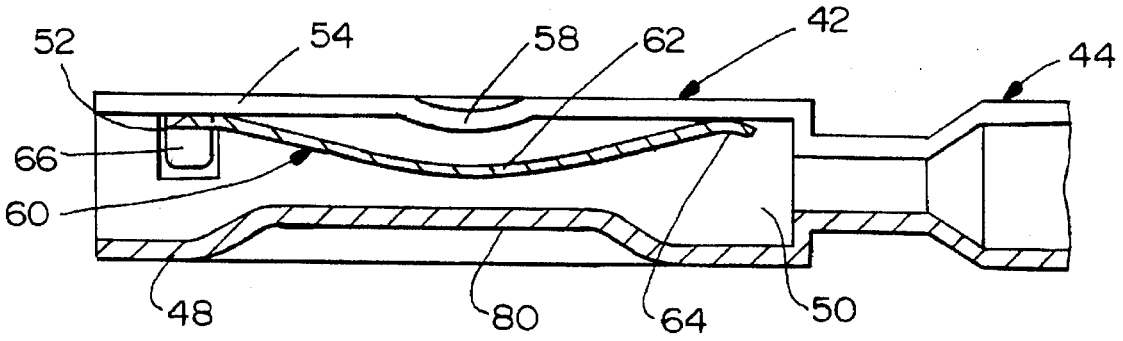
FIG. 6 is an axial section taken generally along line 6—6 of FIG. 3.

FIG. 6 shows the location of spring contact element 60 within contact end 42 of the female terminal. It can be seen that contact blade 62 of the spring contact element is located at the top of the contact end with lug portions 66 captured within the lug-engaging holes 52 at the tops of side walls 50.

FIG. 6 also shows a feature of the invention wherein a portion of bottom wall 48 is formed with a raised boss in the form of a raised rib 80 extending longitudinally of the terminal. As will be seen below, an inserted male terminal is sandwiched between the raised rib and cantilevered contact blade 62 of spring contact element 60. The raised rib portion of the bottom wall is effective to provide a more positive area of contact with the male terminal than simply the enlarged flat bottom wall 48 of the contact end. Such a positive engagement would not be possible with the prior art because the male terminal in the prior art is biased against the spreadable open seam of the contact end of the terminal.

Figure 7:
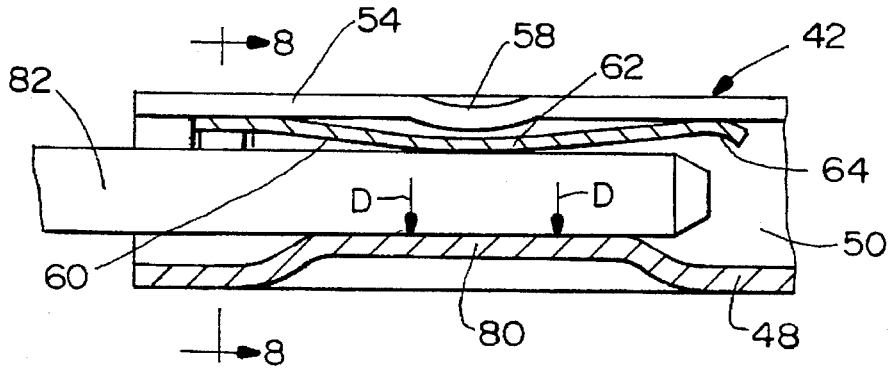
FIG. 7 is an axial section similar to that of FIG. 6, with a male terminal inserted into the female terminal.
Figure 8:
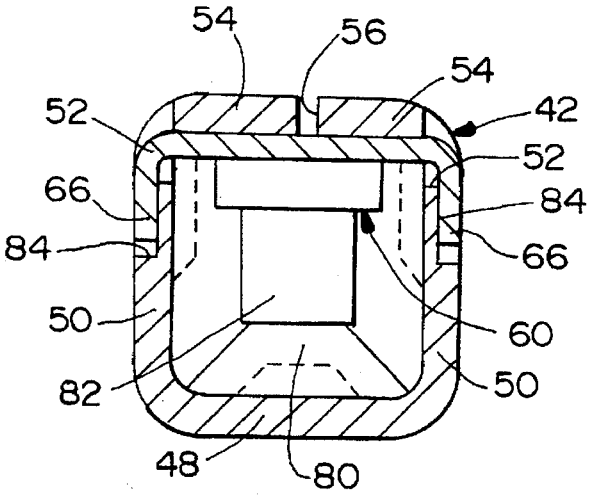
FIG. 8 is a vertical section taken generally along line 8—8 of FIG. 7.

FIGS. 7 and 8 show a male terminal 82 inserted into contact end 42 and into engagement with cantilevered contact blade 62 of spring contact element 60. It can be seen that the contact blade has been compressed, whereby the contact blade essentially biases the male terminal downwardly in the direction of arrows "D" into positive engagement with raised rib 80 above bottom wall 48. FIG. 8 also shows how lugs 66 are bent downwardly within recessed areas 84 in the outside of side walls 50 so that the lugs do not project outwardly beyond the confines of contact end 42 of the terminal. In addition, the downwardly bent lugs assist in preventing side walls 50 and top half walls 54 from spreading apart at seam 56.

Lastly, FIG. 8 shows that contact blade 62 of spring contact element 60 has a substantial width whereby the distal end 64 (FIG. 4) of the contact blade is engageable with substantial portions of top half walls 54 on opposite sides of open seam 56. This substantial engagement, along with lug portions 66 being engaged within recessed areas 84 in side walls 50, substantially eliminates any tendency of the contact end of the terminal to open at seam 56 when male terminal 82 is inserted thereinto.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an elongated female electrical terminal which includes a contact end and a terminating end, the contact end being generally rectangular in cross-section and comprising:

a bottom wall;

a pair of opposing side walls extending upwardly from opposite sides of the bottom wall, and a lug-engaging hole in each side wall distant from the bottom wall;

a pair of opposing top half walls extending inwardly from the tops of the side walls and defining a seam therebetween; and a spring contact element located in the contact end inside said seam and adapted to bias a male terminal into engagement with the bottom wall, wherein the contact element includes at one end lugs for engaging said lug-engaging holes, and at the other end a contact blade engageable with substantial portions of the top half walls on opposite sides of said seam.

2. In an elongated female electrical terminal as set forth in claim 1, wherein said bottom wall includes a raised boss adapted for engaging the male terminal.

3. In an elongated female electrical terminal as set forth in claim 2, wherein said raised boss comprises a raised rib extending longitudinally of the terminal.

4. In an elongated female electrical terminal as set forth in claim 1, wherein a portion of said lugs extend through the lug-engaging holes and said lug portions are bent to engage the side walls to prevent the side walls and the top half walls from spreading apart at said seam.

5. In an elongated female electrical terminal as set forth in claim 4, including recessed areas in the side walls within which the lug portions are bent to be generally flush with the side walls.

6. A female terminal, comprising:

a bottom wall;

a pair of opposing side walls extending upwardly from opposite sides of the bottom wall, and an opening means in each side wall near the top thereof;

top wall means extending inwardly from the distal end of at least one side wall and having a seam;

a spring contact element located inside said seam and including mounting means engageable in said openings to bias a male terminal into engagement with the bottom wall; and wherein said mounting means of the spring contact element extend through opening means in the side walls and the extended portions are bent against the outside of the side walls to prevent the side walls from spreading apart.

7. The female terminal of claim 6, wherein said spring contact element includes a cantilevered contact blade engageable with said top wall means.

8. The female terminal of claim 6, wherein said bottom wall includes a raised boss adapted for engaging the male terminal.

9. The female terminal of claim 8, wherein said raised boss comprises a raised rib extending longitudinally of the terminal.

10. A female terminal, comprising:

a bottom wall;

a pair of opposing side walls extending upwardly from opposite sides of the bottom wall, with a hole in each side wall;

top wall means extending inwardly from the distal end of at least one side wall and having a seam; and a spring contact element located inside the female terminal and including mounting lugs extending outside the terminal through the holes in the side walls, the outside extending portions of the lugs being bent against the side walls to prevent the side walls from spreading apart.

* * * * *